US006871440B2

(12) United States Patent
Highfill et al.

(10) Patent No.: US 6,871,440 B2
(45) Date of Patent: Mar. 29, 2005

(54) MOUNTING SYSTEM FOR CLAY TARGET THROWER AND RIFLE/PISTOL REST

(76) Inventors: Stephen D. Highfill, Route 4, Box 669, California Hot Springs, CA (US) 93207; Salvador Pineda, Route 4, Box 669, California Hot Springs, CA (US) 93207

( * ) Notice: Subject to any disclaimer, the term of this patent is extended or adjusted under 35 U.S.C. 154(b) by 0 days.

(21) Appl. No.: 10/643,720

(22) Filed: Aug. 18, 2003

(65) Prior Publication Data

US 2004/0049966 A1 Mar. 18, 2004

Related U.S. Application Data

(63) Continuation-in-part of application No. 09/847,825, filed on May 1, 2001, now Pat. No. 6,684,550.

(51) Int. Cl.[7] ..... F41A 23/00

(52) U.S. Cl. ..... 42/94; 42/90; 89/37.01; 89/37.04

(58) Field of Search ..... 42/90, 94; 89/37.01, 89/37.04; 124/1, 6, 8, 41.1, 46; 224/520, 524; D22/113

(56) References Cited

U.S. PATENT DOCUMENTS

| | | | | | |
|---|---|---|---|---|---|
| 3,041,938 | A | * | 7/1962 | Seabrook | 89/37.04 |
| 4,501,082 | A | * | 2/1985 | Phillips et al. | 42/94 |
| 4,972,619 | A | * | 11/1990 | Eckert | 42/94 |
| 5,056,410 | A | * | 10/1991 | Pitts | 89/37.04 |
| 5,070,636 | A | * | 12/1991 | Mueller | 42/94 |
| 5,451,088 | A | * | 9/1995 | Broad | 296/26.08 |
| 5,481,817 | A | * | 1/1996 | Parker | 248/286.1 |
| 5,489,110 | A | * | 2/1996 | Van Dusen | 280/415.1 |
| 5,497,575 | A | * | 3/1996 | Fried | 42/94 |
| 5,628,135 | A | * | 5/1997 | Cady | 42/94 |
| 5,666,757 | A | * | 9/1997 | Helmstadter | 42/94 |
| 5,775,560 | A | * | 7/1998 | Zahn et al. | 224/524 |
| 5,811,720 | A | * | 9/1998 | Quinnell et al. | 89/37.04 |
| 5,913,667 | A | * | 6/1999 | Smilee | 42/94 |
| 6,173,705 | B1 | * | 1/2001 | DeWitt | 124/1 |
| 6,305,117 | B1 | * | 10/2001 | Hales, Sr. | 42/94 |
| 6,338,218 | B1 | * | 1/2002 | Hegler | 42/94 |
| 6,539,660 | B1 | * | 4/2003 | Yeargin | 42/94 |

FOREIGN PATENT DOCUMENTS

| | | | |
|---|---|---|---|
| FR | 2442009 | * | 11/1978 |
| GB | 2090951 | * | 7/1982 |

OTHER PUBLICATIONS

"Time Precision Inc", and 'Introduces the New .22 RF Bench Rest Quality Rifle'Nov. 1966, pp1–4.*

* cited by examiner

*Primary Examiner*—Michael J. Carone
*Assistant Examiner*—John Richardson
(74) *Attorney, Agent, or Firm*—Kenneth J. Hovet

(57) ABSTRACT

An L-shaped tube has a horizontal member that fits into a trailer hitch, and a vertical member. A platform is secured to a post that fits into the vertical member. The platform has bolt holes arranged to engage a variety of commercial clay target throwers and a gun/pistol rest. A threaded dowel is inserted through the a 180 degree horizontal slot in the vertical member, and screwed into a threaded hole in the post, thereby limiting the range the platform post can swivel within the vertical member. The dowel can be tightened to lock the post between zero and one-hundred-eighty degrees. A tension cable secures the vertical member to the vehicle to attenuate vibrations. A gun/pistol rest configured to mount from the platform has a forward cradle for a gun stock or barrel, and rear mount that variously functions as a rifle-butt cradle or a pistol-butt support.

9 Claims, 7 Drawing Sheets

MOUNTING SYSTEM FOR CLAY TARGET THROWER AND RIFLE/PISTOL REST

This is a Continuation-in-Part of application Ser. No. 09/847,825 filed May 1, 2001 now U.S. Pat. No. 6,684,550.

BACKGROUND OF THE INVENTION

1. Field of the Invention

The present invention relates to a system for mounting a clay target thrower and rifle/pistol rest from a vehicle trailer hitch. More particularly, the present invention relates to a mounting system for a clay target thrower and rifle/pistol rest capable of connecting with related devices such as a reconfigurable rifle/pistol rest.

2. Description of Related Art

Various innovations for a mounting system for clay target thrower and rifle/pistol rests have been shown and described in the prior art.

One prior art device named, "Dew-itt," is made by the DeWitt Co. of Jackson, Calif. The DeWitt device attaches to a standard two inch by two inch receiver of a pickup truck and allows the operator to be seated while throwing targets. Because an operator typically holds onto the handle while the clay target is fired from the DeWitt mount, the field of operation is limited by the reach of the operator when swiveling the DeWitt mount . . . typically within a range of about 15° of vertical swivel and about 20° of horizontal swivel. Additionally, the DeWitt device is not flexibly configured to accommodate most of the various brands of clay target throwing machines.

Another drawback of the DeWitt mount inheres from the structural limitations of the member configured to couple to a trailer-hitch. Because of the weight of the mount, and the forces imparted through the mount when a clay pigeon is fired, sheer forces are imparted to the DeWitt structure at the point it couples to a trailer-hitch. Additionally, the pin-in-hole connector by which the structure is secured to the trailer-hitch can wiggle and increase the hole size as a result of vibration and wobble in the arm.

In constructing a mounting system, it is desirable to utilize metal parts having a metal gauge light enough to make the device reasonably transportable and easily assembled by the average person. However, light gauge metals will not endure sheer forces typically encountered in mounting systems. On the other hand, a device strong enough to resist degradation and fatigue will be unacceptably heavy, and impractical.

A need, therefore, exists for a trailer-hitch type mount for a clay target-thrower that is light enough to be assembled by one person, but sturdy enough that it will not experience significant degradation and fatigue through use. A need also exists for a mount that is resistant to vibrations known to take place in throwing arms or gun rests. A further need exists for a mounting system that allows a target thrower to be aimed in a variety of directions while limiting the operating range to a safe field of activity.

The need also exists for a rifle/pistol mount that is configured to allow a user to comfortably stand between a vehicle acting as a mount, and the weapon supported by the mount. There is a further need for a mount configured to easily connect with a wide variety of commercial clay target throwers and gun rests. Moreover, there is a need for a mounting system comprising a rifle/pistol mount configured to act as a rest for both pistols and rifles.

SUMMARY OF THE INVENTION

The present invention is directed to a trailer-hitch type mount for a clay target-thrower that is light enough to be assembled by one person, but sturdy enough that it will not experience significant degradation and fatigue through use. The mount is also resistant to vibrations known to take place in throwing arms or gun rests and allows a target thrower to be aimed in a variety of directions while limiting the operating range to a safe field of activity.

The present invention is further directed to a trailer-hitch type mounting system configured to allow a user to comfortably stand between a vehicle acting as a mount support, and the target thrower or gun rest supported by the mounting system. The mount is configured to accommodate a wide variety of commercial clay target throwers and gun rests. Additionally, the invention provides a rifle/pistol mount that is configured to act as a rest for both pistols and rifles.

The invention includes a hollow extender that is engageable with the receiver hitch of any vehicle. It includes connector means for releaseable attachment to rifle and pistol rests or to clay target throwing machines.

The hollow extender further includes a swivel means that allows targets to be thrown in virtually any direction. Safety concerns, however, typically dictate a limited region in which it is safe to track a target and shoot safely. That is, it is unsafe for a shooter to track a target in the direction where other shooters are standing.

To facilitate safe use, the present invention, provides a locking mechanism which limits the field to which a clay thrower can be aimed and locked to a 180 degree range. This safety feature thereby establishes a straight line behind which shooters may safely stand.

The locking mechanism comprises a slot 12CA forming a horizontal arc in the vertical extender 12C. By limiting the rotation of the platform post 14 to the range of the slot, the apparatus can limit the direction that a target is thrown, or the direction that a gun can be directed, thereby enhancing the safety of sport shooting.

In addition to the horizontal control, the device with attachments permits 75° of vertical control for certain brands of throwers not having this feature already built in. The device is preferably manufactured from components that are light, strong, and durable.

The novel features which are considered characteristic for the invention are set forth in the detailed description and the appended claims. The invention itself, however, both as to its construction and its method of operation, together with additional objects and advantages thereof, will be best understood from the following description of the specific embodiments when read and understood in connection with the accompanying drawings.

DESCRIPTION OF THE PREFERRED EMBODIMENT

Figure 1:
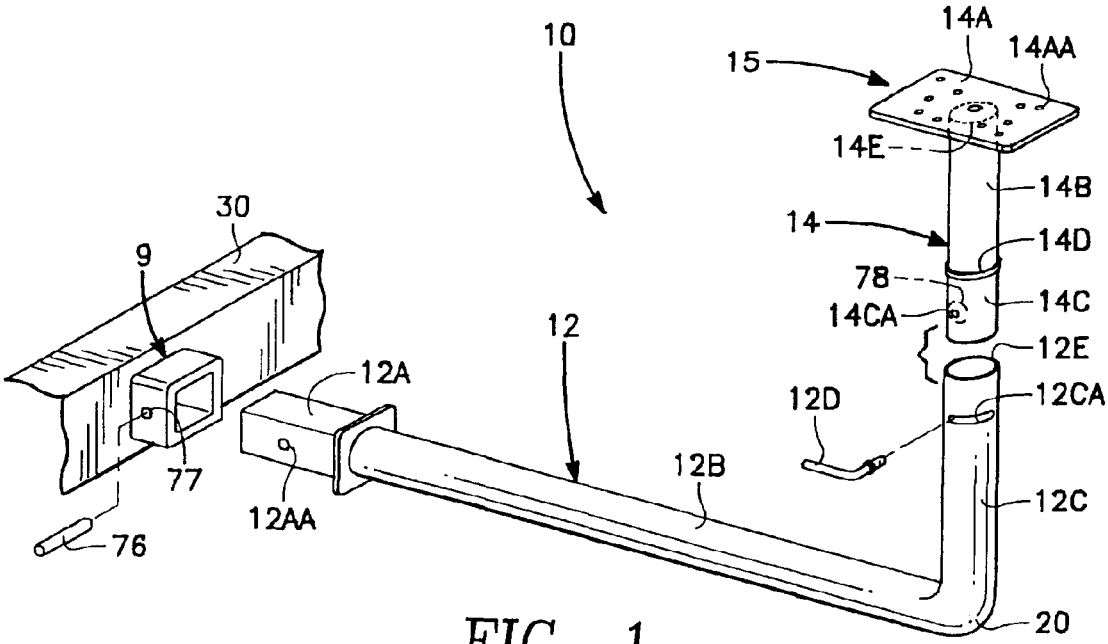
FIG. 1 is a right front isometric view of a mounting system of the present invention attached to a vehicle trailer hitch.
Figure 2:
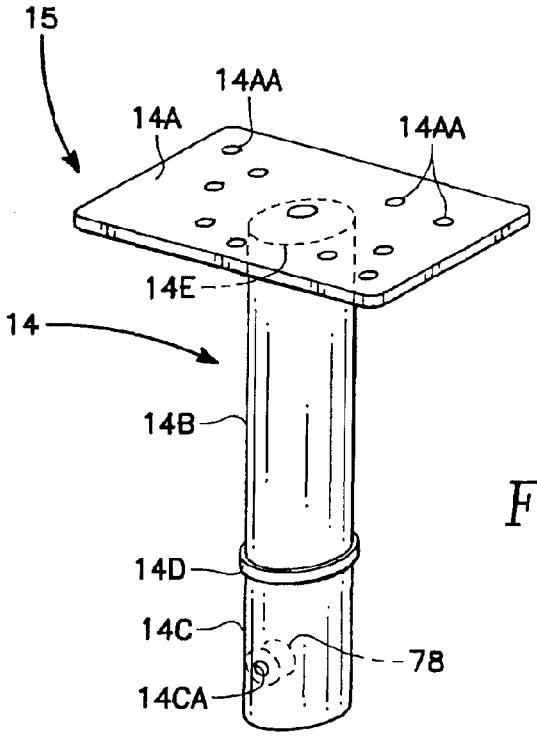
FIG. 2 is a side isometric view of a platform assembly that is a part of the system shown in FIG. 1.

Referring now to FIGS. 1 and 2, the mounting system 10 includes a hollow extender 12, which advantageously comprises a cylindrical rigid pipe. The pipe may be constructed of steel, other metal alloys or plastic materials. The hollow extender 12 is preferably a single contiguous member bent at an elbow 20 to form an extender horizontal member 12B oriented in a substantially horizontal orientation and an extender vertical extender 12C oriented in a substantially vertical orientation. Embodiments are envisioned, however, wherein the horizontal 12B and vertical 12C extenders comprise separate pipe components that can be joined with a 90° pipe fitting. Reference herein to the extender horizontal member 12B and the extender vertical extender 12C includes both an L-shaped continuous construction and a construction utilizing separate parts.

Fixed to the rear distal end of the extender horizontal member 12B, is extender male member 12A. The male member has a cross-section configured to fit snugly into a conventional 2 inch by 2 inch trailer hitch connector opening. The elongated square extender male member 12A or trailer-hitch interface has an extender male member opening 12AA such that it can be secured therein by passing a crosspin 76 through corresponding pin openings 77 in the hitch connector and through opening 12AA in the male member 12A. (Also see FIG. 7). Preferably, the trailer male member 12A comprises an inner diameter 22 that is roughly equal to the outer diameter of the hollow extender 12, and is affixed to the hollow extender by a known means such as welding or set screws, thereby minimizing unwanted "play" and wobbling.

The mechanical force of throwing a clay-target creates vibrations and harmonics within a mounting system. It can be readily appreciated by those skilled in the art that when an arm or mount is secured in a trailer-hitch by a cross pin 76, the play of the pin within the cross pin openings 77 can expand the size of the openings or otherwise degrade the construction and integrity of the hitch connection. However, by coupling the assembly to a trailer hitch 9 through a male member 12A formed from a tooled block of solid steel or a heavy gauge steel, the insertion of a crosspin 76 through a pin opening 77 will not degrade the assembly in the face of vibration.

The mounting system of the present invention is configured to connect with both a clay target thrower and a gun rest. When firing either a gun, or operating a target thrower from a trailer-hitch mount system, the safest direction to direct clay targets, and to discharge firearms, is away from the vehicle. Because of this, when using the mounting system 10 in conjunction with a gun rest, shown by reference 31 in FIG. 8, a shooter must have at least a minimum space to comfortably stand between the back of the vehicle 32 and the gun rest. To create the space, the length of the extender horizontal member 12B should be at least about equal to a shooter's arm length or at least about 30 inches.

With reference to FIGS. 1 & 2, the platform assembly 15 is removably engageable with the extender vertical member 12C. The platform assembly includes a platform post 14 with an outer ring 14D girding a portion of the platform post, and dividing it into a lower platform post 14C and an upper platform post 14B. The platform assembly 15 further includes a platform 14A which is secured to the mouth 14E of upper platform post 14B.

Figure 3:
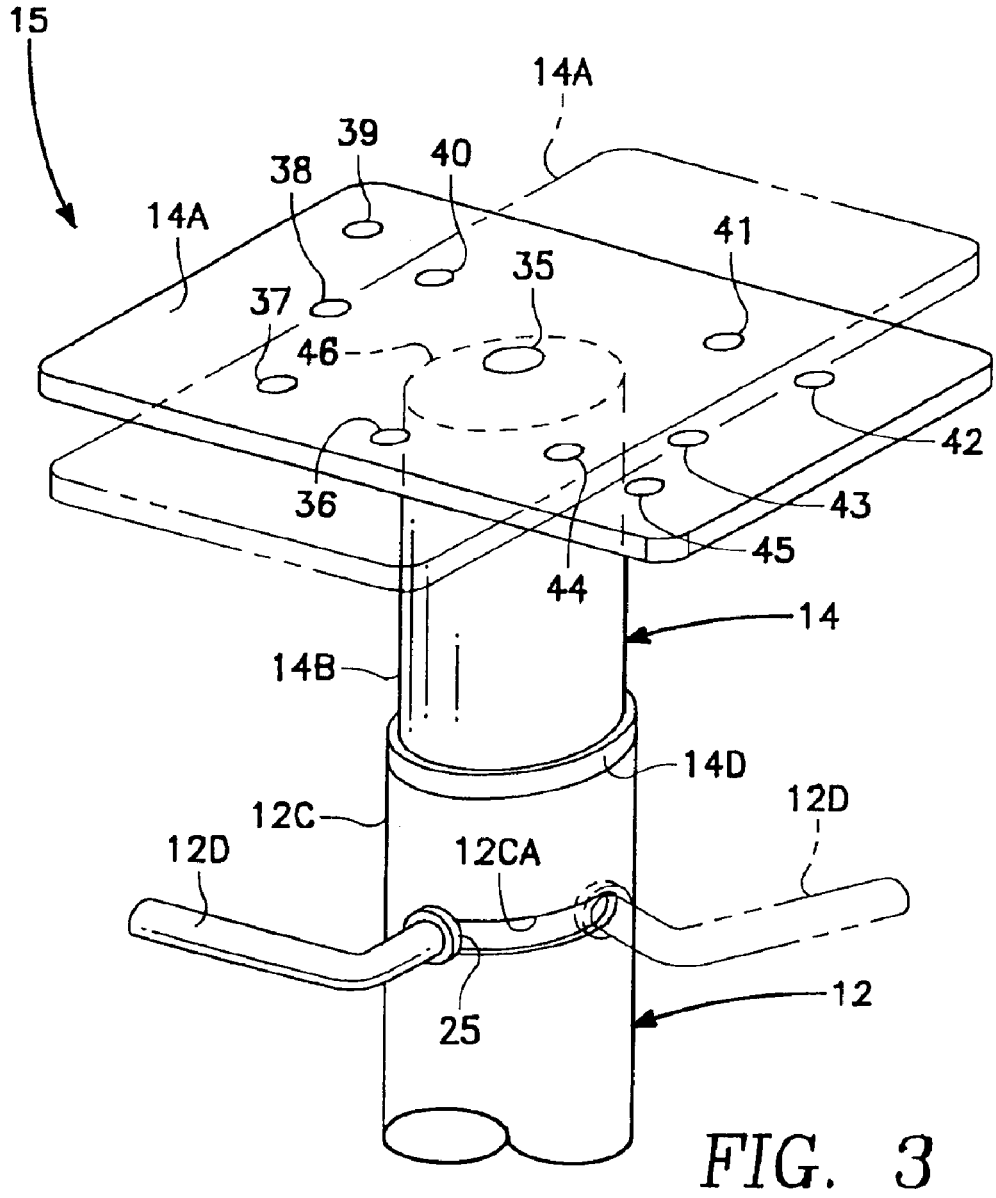
FIG. 3 is a side isometric front right view of the platform assembly shown in FIGS. 1 and 2, illustrating the swivel range of the platform within the limits imposed by the slot when the threaded extender fastener is properly inserted but not tightened.

As illustrated in FIGS. 1 and 3, in assembly, the lower platform post 14C is inserted into the vertical extender 12C, preferably in a snug fit that allows easy insertion and removal, but allows very little play between the two parts. As a consequence, the ring 14D fixed to the outside of the platform post 14C, cannot fit into the extender vertical member. By attaching the ring 14D to the platform post 14C in a secure relationship, either by welding, a set screw, or other secure means, the ring 14D acts as a stop, preventing insertion of the platform post 14C into the extender vertical member 12C at a depth greater than the ring will allow. By securing the ring 14D with set screws, the ring 14D may be vertically movable and be releaseably secured with a fastener or set screw so that the height of platform 14A can be adjusted to the preference of a user.

Figure 11:
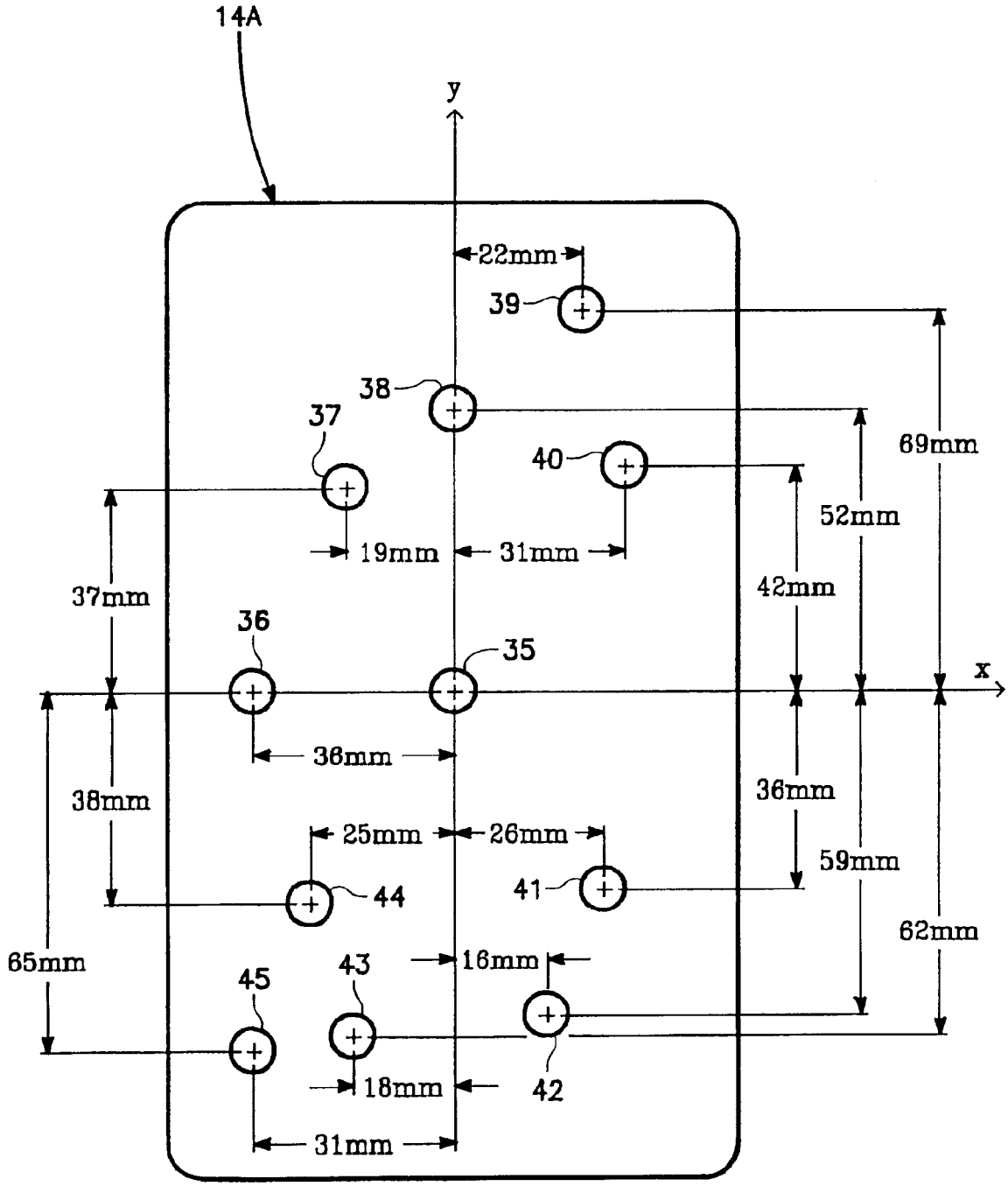
FIG. 11 illustrates a "universal" platform having a bolt pattern configured to allow a wide variety of commercial throwers and gun rests to mount from the mounting system of the present invention.

As discussed in conjunction with FIG. 11, the platform is provided with a plurality of fastener openings 14AA. The fastener openings are arranged in a pattern to accommodate the multiple bolt pattern of most commercial target thrower mounts.

With reference to FIGS. 1–4, the upper portion of vertical extender 12C is provided with slot 12CA formed on a horizontal plane. The slot subtends an arc of approximately one hundred eighty degrees around the circumference of the vertical extender. The lower platform post 14C of the support member includes a threaded fastener opening 14CA. The fastener opening is located below holder ring 14D a distance about equal to the distance slot 12CA is below mouth 12E of vertical extender 12C.

When the fastener opening 14CA and slot are aligned, threaded extender fastener 12D is inserted through the slot and coupled in a threaded engagement with the fastener opening 14CA. Although embodiments are envisioned wherein the wall of the lower platform post 14C is thick enough to tap a thread in the fastener opening 14CA such that the tapped thread can sustain a pull of a threaded shaft 24 inserted through it, according to the preferred embodiment, a nut or weld-mass 78 is disposed behind the hole fastener opening 14CA and secured to the inside surface of the lower platform post 14C, thereby providing a thicker mass to which the threaded shaft of the extender fastener 12C can engage.

Figure 4:
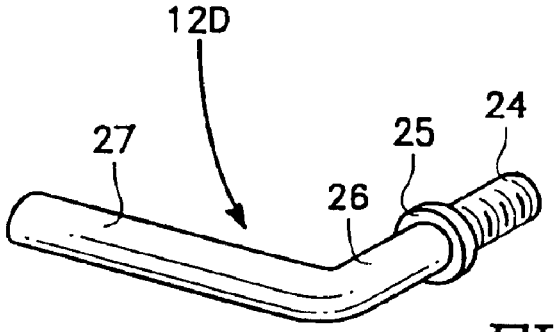
FIG. 4 is a side isometric view of a threaded extender fastener for fastening the platform assembly to the hollow extender.

Referring to FIG. 4, the extender fastener 12D includes a threaded shaft 24 that preferably includes a means of manually applying torque to the shaft without any additional tools. According to FIG. 4, such a torque means can be formed from an elbow 26 forming a perpendicular arm 27. Alternative torque means include a knob, cross piece or spoke-and-wheel design. The recitation of such manual torque devices, however, is not intended to preclude the use of hex-head bolts or other known designs requiring an additional tool for applying torque to a threaded shaft.

The extender fastener 12D functions as a locking mechanism for releaseably securing the platform post 14C in a selected angular position. Referring principally to FIGS. 3 and 4, the extender fastener 12D comprises an abutment means 25 for abutting against and frictionally engaging the outer surface of the vertical extender 12C, thereby pressing the inner surface of the vertical extender 12C against the outer surface of the lower platform post 14C. According to FIG. 4, the abutment means 25 can be advantageously formed from a flange 25 at an end of the threaded portion of the extender fastener. When extender fastener 12D is tightened, the friction prevents the lower platform post 14C from rotating within the vertical extender 12C. When the extender fastener 12D is loosened, the lower platform post 14C is able to freely swivel within the vertical extender 12C.

As discussed above, the slot 12CA forms an arc of approximately one hundred eighty degrees along a horizontal plane. When the threaded shaft 24 of the extender fastener 12D is inserted into the slot 12CA and secured in the threaded fastener opening 14CA, but not tightened, the lower platform post 14C can be rotated within the vertical extender 12C only until the shaft 24 of the extender fastener 12D abuts against one of the ends of the slot 12CA. By forming a slot 12CA with a one hundred eighty degree horizontal arc, the horizontal rotation of the platform post 14, and a clay-target thrower/gun mount coupled thereto, can be swivelled within the same one hundred eighty degree range, thereby limiting the field in which a clay target will be thrown or a gun will be pointed. This provides a significant safety feature wherein the width of the slot provides a specifically defined activity area behind which shooters, operators and bystanders must stand. According to the preferred embodiment, the slot is located on the rearward portion of the vertical extender 12C facing the vehicle bumper, thereby permitting an operator to remain behind the direction of throw of a clay target.

A particular advantage of the slot design is that it does not require a person to hold onto a handle of the clay trap shooting assembly the entire time. The platform post 14 can be locked in place, and the thrower arm can be operated without continual aiming of the assembly. In prior art embodiments wherein a user was required to continually hold an arm of a thrower to steady its direction, the user typically sat on the tail-gate of a pick-up truck from which the device was mounted. Depending on the length of the operator's arms, this typically limited the range of horizontal swivel to approximately sixty degrees. As noted, the 180 degree slot of present invention allows the thrower to be locked in any position within the 180 degree of arc.

One of the disadvantages of prior art devices such as the DeWitt model is that, by securing a neck in a hollow member through cotter pins, "play" or "wiggle" can occur between the neck and the hollow member. Against this, another advantage of the locking mechanism 12D described herein, is that, in addition to locking a target thrower at a desired angle in the locked or tightened mode, the extender fastener 12D eliminates "wobble" or "play" between the holder lower platform post 14C and the extender vertical extender 12C.

Figure 6:
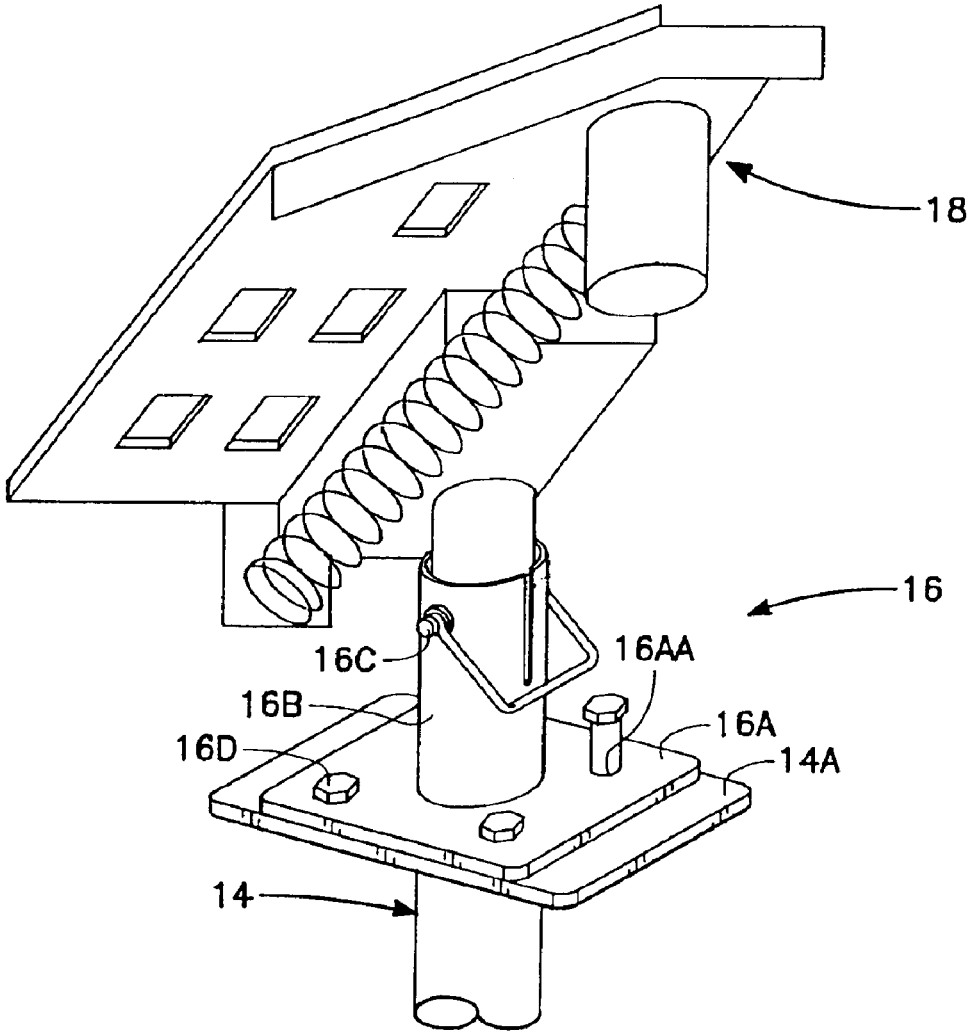
FIG. 6 is a side view of an "Outers" clay target thrower mounted on the universal platform assembly shown in FIGS. 1 & 11.
Figure 7:
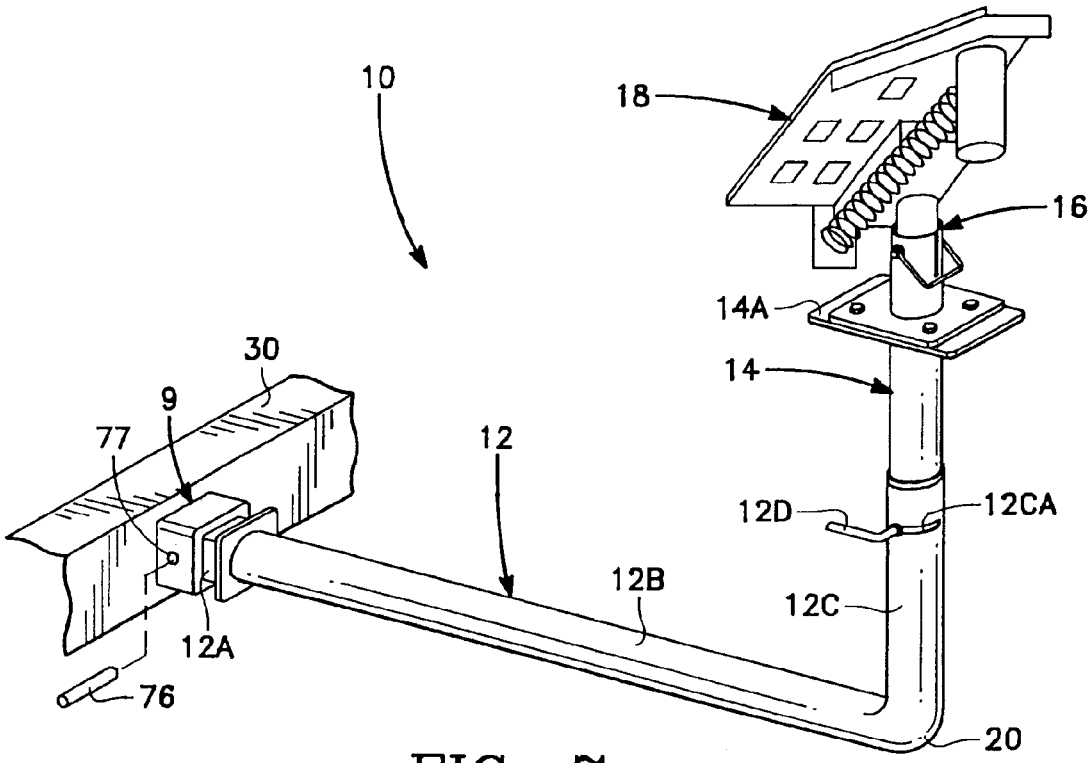
FIG. 7 is a side isometric view of an "Outers" clay target thrower and adapter mounted on the mounting system.

Many trap throwers are capable of mounting directly to the universal platform 14A. Some trap throwers, however, such as the commercially sold "Outers" trap thrower, cannot mount to the universal mounting platform (FIG. 11) directly, but require a specialized interface. FIG. 6 is a side views of a trap holder 16 specifically designed to attach an "Outers" clay target thrower to the mount 14A of the present invention. FIG. 7 shows an "Outers" adapter and clay target thrower mounted on the mounting assembly 10 of the present invention.

The trap holder of FIGS. 6 and 7 comprises a trap holder plate 16A having at least one trap holder plate opening 16AA in a complimentary position to at least one platform opening 14AA (FIG. 3). A trap holder bolt 16D is positioned through the trap holder plate opening 16AA and the platform opening 14AA.

The trap holder 16 further includes a trap holder extender 16B attached at a bottom distal end to a top surface of the trap holder plate 16A. The trap holder extender 16B includes opposing trap holder extender openings 16BB, 16BB (not shown).

Corresponding opposing ends at a U-shaped trap holder fastener 16C engage the extender openings 16BB, 16BB. The trap holder extender 16B is removably connected to a trap thrower 18 by the trap holder fastener 16C. The trap holder plate 16A also includes bolt openings for mounting a special unit on the trap holder plate 16A.

Figure 5:
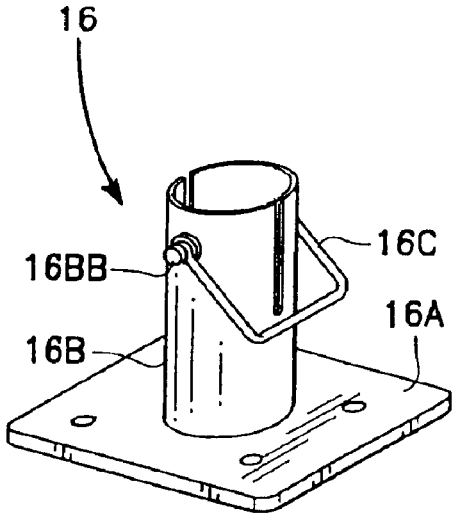
FIG. 5 is a side isometric view of an adapter for mounting an "Outers" clay target thrower on the mounting system.

The above discussion of the trap holder 16 is offered herein for exemplary purposes. It is offered to show that a trap thrower or gun mount that does not fit directly onto the mounting system of the present invention can nevertheless be made to fit the universal platform 14A of the present invention through a specialized interface member, as shown by the trap holder fastener 16C in FIGS. 5, 6 and 7.

Universal Platform

As best shown in FIG. 11, a unique feature of the present invention is the arrangement of platform openings 14AA in the platform 14A. These openings 14AA are configured to maximize the universal flexibility of the present invention. Although other size holes are envisioned, the holes 14AA preferably range in size from a quarter inch to three eights inches in U.S. measurements, or from six to eight mm in metric sizes.

Orienting all measurements from the center of hole 35 relative to the x and y axes, a pattern can be defined as illustrated in FIG. 11. The platform 14 is formed on polygonal platform 14A which extends from +52 mm to −52 mm on the x axis, and from 87 mm to −90 mm on the y axis. The mouth 14E of the upper platform post 14B is welded to the bottom of the platform 14A around the (0,0) axis, defining arc 46, and defining the center axis. Hole 35 is centered at (0,0) mm on the x,y plane. Hole 36 is centered at (−36,0) mm on the x,y plane. Hole 37 is centered at (−19.5,19) mm on the x,y plane. Hole 38 is centered at (0,52) mm on the x,y plane. Hole 39 is centered at (22,69) mm on the x,y plane. Hole 40 is centered at (31,42) mm on the x,y plane. Hole 41 is centered at (26.5,−31) mm on the x,y plane. Hole 42 is centered at (16.5, −59) mm on the x,y plane. Hole 43 is centered at (−18,−62) mm on the x,y plane. Hole 44 is centered at (−25,−38) mm on the x,y plane. Hole 45 is centered at (−31,−65) mm on the x,y plane. The coordinate axises as explained herein are according to the view from the top side of the platform 14A. When the platform openings 14AA are formed in the platform 14A according to the co-ordinate pattern disclosed above, the platform 14A will function as an almost universal mount for a great variety of commercially manufactured clay target throwers designed for mounting from a transportable platform.

Vibration Damper and Mount Stabilizer

Figure 8:
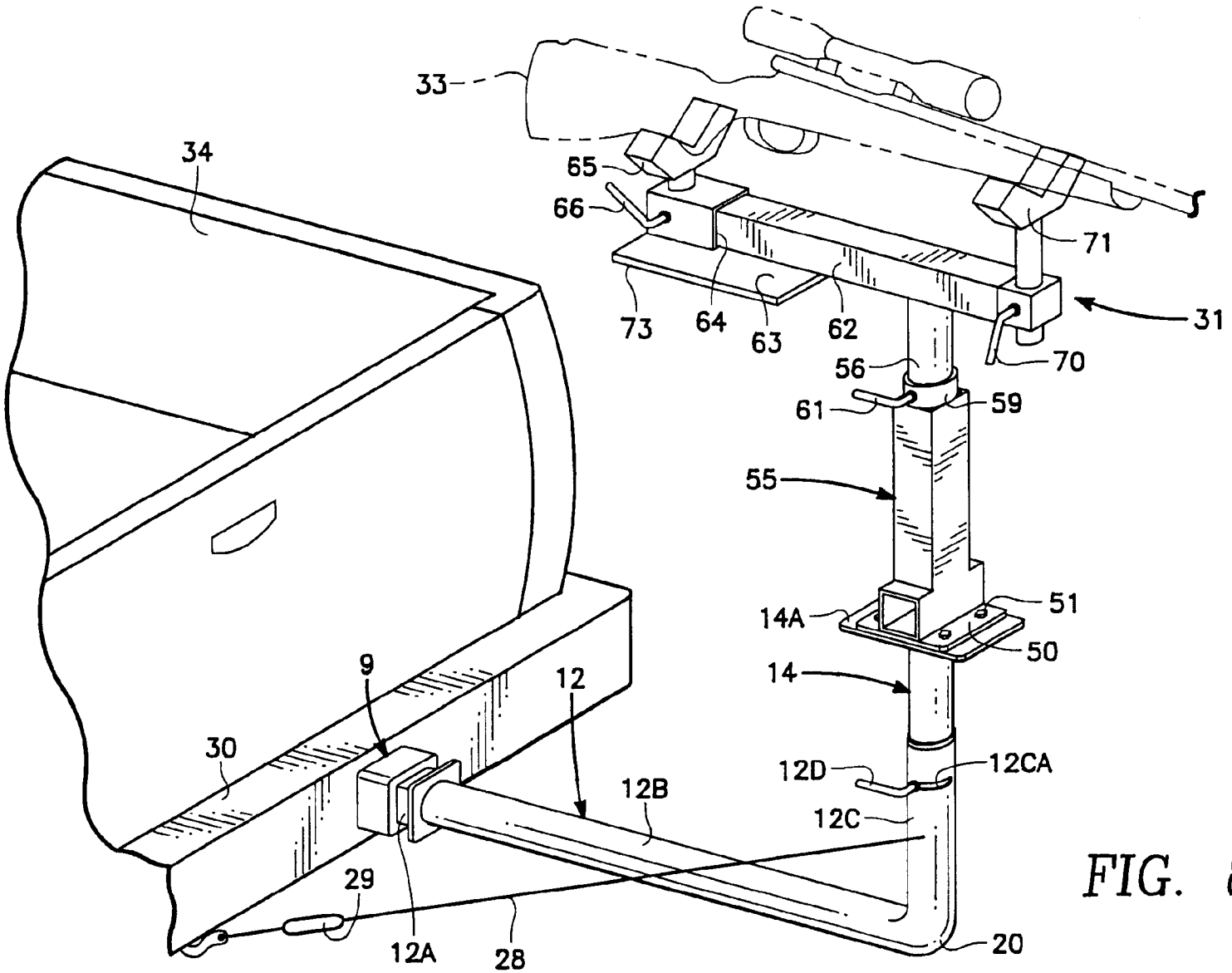
FIG. 8 illustrates the mounting system of the present invention including a pistol/rifle mount, as extending from the trailer hitch of a vehicle.

The actuation of a clay target thrower, or the firing of a rifle or pistol from a gun rest mounted on the assembly can transmit vibrations through the mounting system 10. In general, it is preferable to minimize the amplitude of the vibrations transmitted through the mounting system 10, and to dampen the vibrations as quickly as possible. A particular feature of the present invention, as shown in FIG. 8, minimizes vibrations by utilization of a stabilizer cable 28. The stabilizer cable 28 is affixed at a first end to the extender vertical extender 12C, and at a second end to a turnbuckle 29. The turnbuckle is used to adjust the tension in the stabilizer cable 28. The turnbuckle 29 is anchored to the bumper of the automobile or truck from which the mounting system 10 is mounted.

As illustrated in FIG. 8, the turnbuckle 29 is preferably anchored several feet away from the trailer hitch 9. The angle formed along the horizontal plane between the extender horizontal member 12B and the cable 28 exerts a horizontal component of force perpendicular to the extender horizontal member, thereby reducing the amplitude of vibrations on the horizontal plane.

The stabilizer cable 28 is mounted several inches above elbow 20 of the hollow extender 12. By mounting the stabilizer cable with a vertical disparity between the first end coupled to the vertical extender 12C and the end coupled to the vehicle bumper 30, a vertical rotational moment is also exerted on the mounting system 10. This overall arrangement thereby minimizes the amplitude of vibrations experienced on both a horizontal and vertical planer orientation.

Gun Rest

Figure 9:
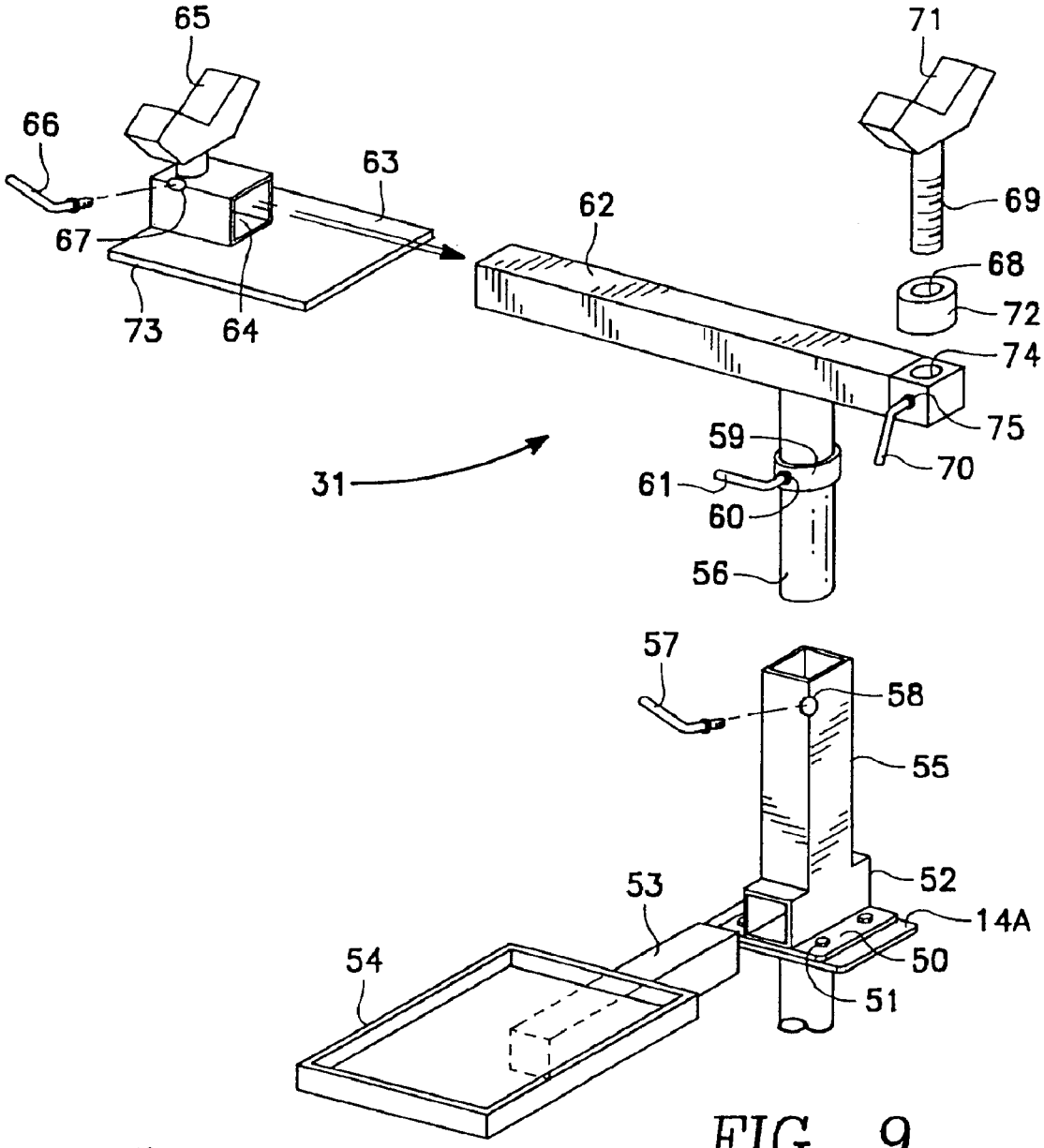
FIG. 9 illustrates an isometric exploded view of the component parts shown in FIG. 8.
Figure 10:
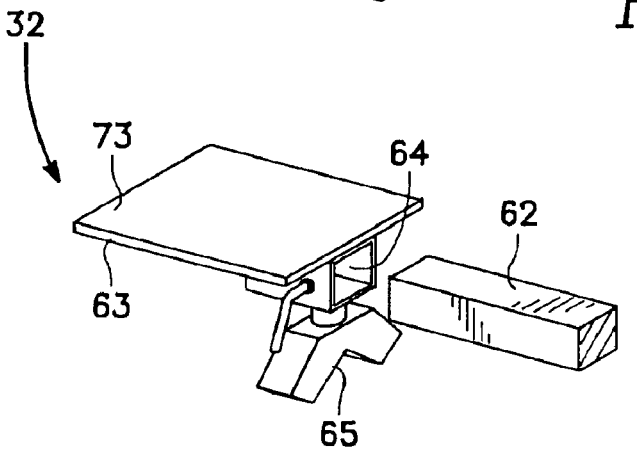
FIG. 10 is an exploded view of the pistol mount of the invention, formed by a 180 degree inversion of portions of the pistol/rifle mount of FIG. 8.

Referring principally to FIGS. 8–10, the various design features of the mounting system 10 make it ideal for supporting pistol and rifle rests 32, 31, as well as for supporting clay target throwers 18. FIG. 8 illustrates the gun rest 31 of the present invention mounted on the mounting system 10. The gun rest is uniquely configured to flexibly switch from a pistol rest 32 to a rifle rest 31 without tools by adjusting only a few components. As shown in FIGS. 8 and 9, the gun mount base 50 is configured with mounting holes 51 oriented to align with selected holes 14AA (FIGS. 1, 3 and 11) of the platform 14A.

An upright guide 55 can be coupled directly to the gun mount base 50. However, according to the preferred embodiment, as illustrated in FIG. 8 and 9, the upright guide 55 extends from the top of a tray guide 52. The tray guide 52 is formed from a hollow conduit member configured to receive tray slide 53. The tray slide 53 is connected to tray 54. The attached tray 54 enables a shooter to place ammo, tools, scopes, clips, speed loaders and other items on the tray 54 adjacent to where he/she is shooting.

Although the tray slide 53 and tray guide 52 are shown with a square cross-section in FIG. 10, any shape is envisioned in conjunction with the present invention. However, because the tray could turn upside down if supported by a cylindrical slide in a cylindrical guide, according to the preferred embodiment, the tray slide 53 and tray guide 52 should have some corresponding flat surfaces to prevent rotation of the slide 53 within the guide 52.

The neck 56 of the gun mount lowers into the hollow upright guide 55, as illustrated by the orientation of the elements in FIG. 9. The neck 56 is girded by an adjustable depth ring 59 having a threaded nut 60 attached thereto. A depth ring handle 61 with a threaded shaft is configured to screw into the threaded nut 60 of the adjustable depth ring 59, thereby exerting pressure on the neck 56 and securing the adjustable depth ring 59 to a desired point on the neck 56. As the neck 56 is then lowered into the upright guide 55, the depth ring 59 will act as a stop against the upright guide, thereby fixing the depth to which the neck 56 can be lowered into the upright guide 55. This establishes the height of the gun mount guide 62 affixed to the top of the neck 56.

An anti-swivel lever 57 is provided to upright guide 55. It comprises a threaded shaft preferably operated manually by an appropriate piece such as an elbow, cross-piece, or knob. The threaded shaft is configured to screw into an anti-swivel nut 58 welded over a hole in the upright guide. As the anti-swivel lever 57 is tightened, the shaft on the anti-swivel knob exerts a force against the neck 56. This force not only restricts free rotation of the neck within the upright guide, it also reduces "play" of the neck 56 within the upright guide 55.

A pistol mount platform 63, made of a rigid material such as wood, plastic or steel, is secured to a rigid gun mount guide 64. Resting on the top of the gun mount guide 64, opposite the platform 63, is a "Y" shaped rear rifle cradle 65, preferably made of a rigid material such as metal and coated with a soft material such as rubber or foam to avoid scratching a rifle butt. The soft material also increases friction and improves the settling of a rifle butt in the rear rifle cradle 65.

The gun mount slide 62 is a structural support member configured to slide into the gun mount guide 64. Because no rotation or "swivel" of the pistol mount platform 63 around the gun mount slide 62 is desired, a geometry comprising flat surfaces in the gun mount guide 64 and gun mount slide 62 is desired. FIGS. 8-10 illustrate a square guide 64 configured to slide onto a square slide 62. The square configuration has the further advantage of allowing the pistol mount platform 63 to be mounted upside down, as illustrated in FIG. 10. As the gun mount guide 64 is slid onto the gun mount slide 62, the pistol mount platform 63 and rear rifle cradle 65 are supported by the slide 62.

When the rear rifle cradle 65 is oriented in an uppermost position, the mount is configured as a rifle rest 31 for firing a rifle supported by the forward cradle 71 and the rear rifle cradle 65. The rifle rest orientation is illustrated in FIGS. 8–9. When the gun mount guide 64 is slid onto the gun mount slide 62 with the rear rifle cradle 71 on bottom, the gun mount is configured as a pistol rest, as shown in FIG. 10. Because the pistol mount platform 63 is preferably comprised of metal, the "upper" surface of the pistol mount platform, (when referenced from the pistol rest orientation of FIG. 10), is advantageously coated with a friction layer of rubber or foam 73. A first advantage of the coating 73 is that, when the butt of a pistol is placed against the coating, a skid-resistant relationship is established. A second advantage is that the coating attenuates vibrations transmitted through the metal platform 63 to the pistol butt.

To secure the gun mount guide 64 to a particular point on the gun mount slide 62, the gun mount guide includes a threaded hole 67. The threaded hole 67 can be an attached nut over a hole, or simply a weld-mass built up on the gun mount guide. A gun mount fastener 66, comprising a handle or knob and a threaded shaft, is inserted into the threaded hole 67. It may then be tightened to secure the gun mount guide 64 to the pistol mount platform 63 and the rear rifle cradle 64 to the gun mount slide 62.

The forward cradle 71 is a "Y" shaped structure preferably comprised of a material or finish that will not easily scratch a rifle stock or pistol barrel, such as wood, nylon or plastic. The forward cradle rests on a threaded forward cradle shaft 69, preferably comprising from six to twelve threads per inch to allow for rapid adjustment of the height of the forward cradle 71. To quickly adjust the height of the forward cradle 71, the forward cradle shaft 69 is first screwed into a donut adjuster 72 having a threaded donut hole 68 and then guided into the vertical guide 74, disposed on the distal end of the gun mount slide 62. The vertical guide 74 is a hollow unthreaded passage way configured to receive the forward cradle shaft 69. When assembled, the donut adjuster 72 rests against gun mount slide 62, thereby establishing the height of the forward cradle 71 according to how far the forward cradle shaft 69 is threaded into the donut adjuster 72.

To prevent the forward cradle shaft 69 from turning within the vertical guide 74 during shooting, a threaded vertical guide hole 75 is formed in the vertical guide. Threading can be formed by tapping, by a weld mass or by a weld nut affixed over the hole. A forward cradle lock 70 comprises a handle such as a lever or knob, and a threaded shaft. The threaded shaft of the forward cradle lock screws into the threaded vertical guide hole 75 and is secured against the forward cradle shaft 69, to impede free rotation of the shaft 69 within the vertical guide.

While the invention has been illustrated and described as embodied in a mounting system for clay target thrower and rifle/pistol rest, the foregoing description is not intended to limit applications of the present invention to the details disclosed herein. For example, the recitation of a material used in construction are exemplary. Similarly, the recitation of "tool free" locking devices utilizing a knob or bent handle for manually turning a threaded shaft are illustrative of one structure, and are not intended to limit the present invention to these specific embodiments. Similarly, the terms "clay target thrower," "trap thrower" and the like are intended in the broadest sense as throwing any type of target for shooting, and are not to be interpreted in a narrow sense that restricts the use of the present mounting system exclusively to targets made of clay, or exclusively for targets following a flight pattern specifically conforming to the rigid definition of "trap shooting."

In other places within the detailed description, many specific details commonly known to those skilled in the art are not included so as to not unnecessarily obscure the novel features of the present invention. It will be understood that various omissions, modifications, substitutions and changes in the forms and details of the device illustrated and in its operation can be made by those skilled in the art without departing in any way from the spirit and scope of the present invention.

What is claimed is:

1. A gun mount for a pistol having a barrel and butt or a rifle having a barrel and a butt comprising:

a) a forward cradle for supporting the barrel of said pistol or rifle; and b) a rear support that is configurable in at least a first mode and a second mode, the first mode comprising a rear cradle aligned with said forward cradle for supporting a rifle in the forward cradle and the rear cradle, and the second mode comprising an invertable pistol mount platform having an upper surface for supporting said pistol butt while said pistol barrel is aligned in said forward cradle, and an opposing surface that is coupled to said rear cradle.

2. The gun mount according to claim 1 including a rear support interface member that interconnects said rear cradle and opposing surface, said rear support interface member configured to releasably engage a stationary member, and wherein a conversion of said rear support from the first mode to the second mode includes a withdrawal of the rear support from the stationary member, a rotation of the rear support by at least ninety degrees, and a re-engagement of the rear support with the stationary member.

3. The gun mount according to claim 2 wherein said rear support interface member is a hollow guide and said stationary member is a hollow slide configured to slide into the hollow guide.

4. The gun mount according to claim 1 including a gun mount base from which extends an upright guide, said forward cradle adjustably coupled to said upright guide, said gun mount base configured to couple with a mounting system extended from a trailer hitch on a vehicle.

5. The gun mount according to claim 1 comprising a threaded shaft coupled to said forward cradle, said gun mount further comprising a forward cradle height adjuster with a threaded hole for receiving said threaded shaft, such that rotation of said forward cradle height adjuster in a first direction will raise the forward cradle, and rotation of said forward cradle height adjuster in a second direction will lower the forward cradle.

6. The gun mount according to claim 1 further comprising a forward cradle lock for locking said forward cradle in a fixed position.

7. The gun mount according to claim 4 further comprising:

a) a neck attached to said stationary member;

b) an upright guide supported by said gun mount base for receiving said neck; and c) a movable ring coupled to said neck, said movable ring configured such that, in an unlocked mode, said movable ring can be moved up and down said neck, and in the locked mode, said movable ring is locked in a fixed position on said neck, such that, in the locked mode, said movable ring regulates a depth to which said neck can be inserted into said upright guide.

8. The gun mount according to claim 1 further comprising a tray coupled to said gun mount.

9. The gun mount according to claim 8 comprising a tray guide coupled to said gun mount and a tray slide coupled to the tray, wherein the tray couples to the gun mount by inserting the tray slide into the tray guide.

* * * * *